US008132902B2

(12) United States Patent
Shibata et al.

(10) Patent No.: US 8,132,902 B2
(45) Date of Patent: Mar. 13, 2012

(54) INKJET RECORDING APPARATUS

(75) Inventors: Hiroshi Shibata, Kanagawa-ken (JP); Masahito Katada, Kanagawa-ken (JP); Yuko Katada, legal representative, Ebina (JP); Atsushi Murakami, Ebina (JP)

(73) Assignees: Fujifilm Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 304 days.

(21) Appl. No.: 12/470,211

(22) Filed: May 21, 2009

(65) Prior Publication Data

US 2010/0073437 A1 Mar. 25, 2010

(30) Foreign Application Priority Data

May 22, 2008 (JP) ..... 2008-134743

(51) Int. Cl.
*B41J 2/18* (2006.01)

(52) U.S. Cl. ..... 347/89

(58) Field of Classification Search ..... None
See application file for complete search history.

(56) References Cited

U.S. PATENT DOCUMENTS

| | | | | |
|---|---|---|---|---|
| 5,910,810 | A | 6/1999 | Brooks et al. | |
| 7,097,287 | B2 * | 8/2006 | Nakao et al. | 347/85 |
| 7,896,966 | B2 * | 3/2011 | Masuyama et al. | 118/600 |
| 2002/0001024 | A1 | 1/2002 | Wouters et al. | |
| 2003/0122905 | A1 * | 7/2003 | Suzuki et al. | 347/85 |
| 2005/0219282 | A1 | 10/2005 | Kachi | |
| 2007/0091150 | A1 | 4/2007 | Kodama | |
| 2007/0115311 | A1 | 5/2007 | Takatsuka | |
| 2007/0126816 | A1 * | 6/2007 | Nishida | 347/85 |
| 2007/0252860 | A1 | 11/2007 | Nitta et al. | |

FOREIGN PATENT DOCUMENTS

| | | | |
|---|---|---|---|
| EP | 0916502 | A3 | 5/1999 |
| JP | 4-53754 | A | 2/1992 |
| JP | 10-114081 | A | 5/1998 |
| JP | 2000-280493 | A | 10/2000 |
| JP | 2005-280246 | A | 10/2005 |
| JP | 2007-130907 | A | 5/2007 |
| WO | WO 2006064040 | A1 * | 6/2006 |

* cited by examiner

*Primary Examiner* — Matthew Luu
*Assistant Examiner* — Erica Lin
(74) *Attorney, Agent, or Firm* — Birch, Stewart, Kolasch & Birch, LLP.

(57) ABSTRACT

An inkjet recording apparatus includes: a recording head including an introduction section, a discharge section and nozzles; a first liquid chamber connected to the introduction section; a second liquid chamber connected to the discharge section; a first buffer tank which is connected to the first liquid chamber and an interior of which is open to air; a second buffer tank which is connected to the second liquid chamber and an interior of which is open to air; and a pressure control device which sets target pressures of the first liquid chamber and the second liquid chamber in such a manner that a prescribed back pressure is applied to the liquid inside the nozzles of the recording head while a prescribed pressure differential is provided between the first liquid chamber and the second liquid chamber, and controls driving of the first pump and the second pump in accordance with determination results of the pressure determination device in such a manner that the internal pressures of the first liquid chamber and the second liquid chamber remain constant at the target pressures, wherein the first buffer tank and the second buffer tank are connected via a flow channel, and at least one of a filter and a deaeration device is provided in the flow channel.

3 Claims, 8 Drawing Sheets

INKJET RECORDING APPARATUS

BACKGROUND OF THE INVENTION

1. Field of the Invention

The present invention relates to an inkjet recording apparatus, and more particularly, to ink supply technology which enables highly accurate control of back pressure even in the case of ink of high viscosity and large flow volume.

2. Description of the Related Art

Conventionally, an inkjet recording apparatus is known which comprises an inkjet type of recording head having a plurality of nozzles and which records a desired image on a recording medium by ejecting ink droplets respectively from the nozzles in accordance with input image data. The ink ejection method may be a piezoelectric method in which ink droplets are ejected from nozzles by utilizing the displacement of piezoelectric elements to pressurize the ink inside pressure chambers, or a thermal method in which ink droplets are ejected from nozzles due to the pressure created by the growth of gas bubbles which are generated inside pressure chambers by means of the thermal energy created by heating elements, such as heaters, or the like. Recording apparatuses of this kind are used in a wide range of fields from commercial to industrial applications, due to their low operating noise, low running costs, and their capacity to record images of high quality onto recording media of many various types.

When the ink contains air bubbles, the pressure applied to the ink inside the pressure chamber is absorbed by the air bubbles which have compressive properties, and the ink droplet ejection performance declines. One of the reasons for the occurrence of these air bubbles is the presence of dissolved gas in the ink. The phenomenon whereby dissolved gas contained in ink is converted into gas bubbles by the high-frequency vibrations generated by the pressure generating device is known as "cavitation". Therefore, it is necessary to remove dissolved gas from the ink supplied to the recording head, and various technologies for removing dissolved gas from the ink have been proposed hitherto. For example, Japanese Patent Application Publication No. 2007-130907 discloses an inkjet recording apparatus comprising a heating mechanism which heats the ink in an ink supply channel between an ink storage unit which stores ink and a deaeration apparatus, in order to resolve the problem of ejection defects caused by the occurrence of ink supply deficiencies depending on the rate of consumption of the ink. According to this recording apparatus, it is possible to introduce ink into the deaeration apparatus in a state of lowered ink viscosity, and hence the pressure loss can be reduced.

Furthermore, Japanese Patent Application Publication No. 2005-280246 discloses an inkjet recording apparatus (inkjet printer) in which, in order to reduce pressure loss in the pressure loss portion of an ink supply section (for example, filters, or the like) and to ensure stable ink supply even if there is a change in print duty, a flow rate adjustment device is provided to control the flow rate of the ink passing through the pressure loss portion of the ink supply path so as to assume a prescribed flow rate, in accordance with the print duty. According to this recording apparatus, the flow rate of the ink passing through the pressure loss portion is controlled by adjusting the temperature of the ink and thereby adjusting the viscosity of the ink.

However, the inkjet recording apparatus described in Japanese Patent Application Publication No. 2007-130907 has problems in that the pressure loss increases as the volume of ink flowing per unit time through the deaeration apparatus becomes greater (in other words, in cases of large flow rate).

Furthermore, since the temperature of the ink is not constant over time, then there is a possibility that the ejection properties decline. Moreover, if the pressure loss in the deaeration apparatus becomes large, then a blocked state occurs in the deaeration apparatus and there are also concerns about the difficulty in maintaining the back pressure of the recording head.

Furthermore, the inkjet recording apparatus described in Japanese Patent Application Publication No. 2005-280246 has a problem in that ejection stability is poor due to change in the temperature of the ink with the print duty. Moreover, it is also necessary to provide a mechanism for implementing control in accordance with the print duty, and this can also lead to increased costs.

SUMMARY OF THE INVENTION

The present invention has been contrived in view of these circumstances, an object thereof being to provide an inkjet recording apparatus in which high-precision back pressure control is possible even in the case of an ink of high viscosity and large flow volume.

In order to attain an object described above, one aspect of the present invention is directed to an inkjet recording apparatus comprising: a recording head of an inkjet type including an introduction section of introducing liquid into the recording head, a discharge section of discharging the liquid that has circulated through an interior of the recording head, to an exterior of the recording head, and a plurality of nozzles from which droplets of the liquid are ejected; a first liquid chamber connected to the introduction section of the recording head; a second liquid chamber connected to the discharge section of the recording head; a first buffer tank which is connected to the first liquid chamber and an interior of which is open to air; a second buffer tank which is connected to the second liquid chamber and an interior of which is open to air; a liquid supply source which is connected to the first buffer tank or the second buffer tank; a first pump which moves the liquid in both directions between the first liquid chamber and the first buffer tank; a second pump which moves the liquid in both directions between the second liquid chamber and the second buffer tank; a pressure determination device which determines internal pressures of the first liquid chamber and the second liquid chamber; and a pressure control device which sets respective target pressures of the first liquid chamber and the second liquid chamber in such a manner that a prescribed back pressure is applied to the liquid inside the plurality of nozzles of the recording head while a prescribed pressure differential is provided between the first liquid chamber and the second liquid chamber, and controls driving of the first pump and the second pump in accordance with determination results of the pressure determination device so as to control pressures in the first liquid chamber and the second liquid chamber in such a manner that the internal pressures of the first liquid chamber and the second liquid chamber remain constant at the target pressures respectively, wherein the first buffer tank and the second buffer tank are connected via a flow channel, at least one of a filter and a deaeration device is provided in the flow channel, and the liquid in the second buffer tank is supplied to the first buffer tank via the at least one of the filter and the deaeration device.

According to this aspect of the invention, since the filter and/or deaeration apparatus is provided outside the path between the first and second liquid chambers and the buffer tanks respectively corresponding to same, then it is possible to reduce the load on the first and the second pumps when the pressure in the liquid chambers is controlled by using the first and second pumps to move ink between the first and second liquid chambers and the respectively corresponding buffer tanks. Consequently, even in the case of an ink of high viscosity and large flow volume, it is possible to control the back pressure accurately and to ensure stable ejection performance, irrespectively of the print duty.

The pressure determination device which determines internal pressures of the first liquid chamber and the second liquid chamber may be realized by one integrated element or a plurality of elements which are disposed separately or integrated to form one structure.

Desirably, the first and second buffer tanks each have a temperature adjustment function.

According to this aspect of the invention, since the first and the second buffer tanks comprise a temperature adjustment function, then if a deaeration device is provided in the flow channel between the buffer tanks, it is possible to adjust the temperature of the ink after to deaeration, as well as before deaeration, and therefore the deaeration effect is improved. Moreover, it also becomes possible to achieve precise temperature control.

In order to attain an object described above, another aspect of the present invention is directed to an inkjet recording apparatus comprising: a recording head of an inkjet type including an introduction section of introducing liquid into the recording head, a discharge section of discharging the liquid that has circulated through an interior of the recording head, to an exterior of the recording head, and a plurality of nozzles from which droplets of the liquid are ejected; a first liquid chamber connected to the introduction section of the recording head; a second liquid chamber connected to the discharge section of the recording head; a buffer tank which is connected to the first liquid chamber and the second liquid chamber, and an interior of which is open to air; a liquid supply source which is connected to the buffer tank; a first pump which moves the liquid in both directions between the first liquid chamber and the buffer tank; a second pump which moves the liquid in both directions between the second liquid chamber and the buffer tank; a pressure determination device which determines internal pressures of the first liquid chamber and the second liquid chamber; and a pressure control device which sets respective target pressures of the first liquid chamber and the second liquid chamber in such a manner that a prescribed back pressure is applied to the liquid inside the plurality of nozzles of the recording head while a prescribed pressure differential is provided between the first liquid chamber and the second liquid chamber, and controls driving of the first pump and the second pump in accordance with determination results of the pressure determination device so as to control pressures in the first liquid chamber and the second liquid chamber in such a manner that the internal pressures of the first liquid chamber and the second liquid chamber remain constant at the target pressures respectively, wherein the buffer tank has a circulation flow channel, at least one of a filter and a deaeration device is provided in the circulation flow channel, and the liquid in the buffer tank is circulated to the buffer tank via the at least one of the filter and the deaeration device provided in the circulation flow channel.

According to this aspect of the invention, since the filter and/or deaeration apparatus is provided outside the path between the first and second liquid chambers and the buffer tank, then it is possible to reduce the load on the first and the second pumps when the pressure in the liquid chambers is controlled by using the first and second pumps to move ink between the first and second liquid chambers and the corresponding buffer tank. Consequently, even in the case of an ink of high viscosity and large flow volume, it is possible to control the back pressure accurately and to ensure stable ejection performance, irrespectively of the print duty.

Desirably, the buffer tank has a temperature adjustment function.

According to this aspect of the invention, since the buffer tank comprises a temperature adjustment function, then if a deaeration device is provided in the circulation flow channel between the buffer tanks, it is possible to adjust the temperature of the ink after deaeration, as well as before deaeration, and therefore the deaeration effect is improved. Moreover, it also becomes possible to achieve precise temperature control.

Desirably, the inkjet recording apparatus comprises a first sub tank and a second sub tank, wherein the first sub tank has a first closed container containing a first gas chamber and the first liquid chamber which are separated by a first flexible film, and the second sub tank has a second closed container containing a second gas chamber and the second liquid chamber which are separated by a second flexible film.

According to this aspect of the invention, it is possible to attenuate pressure variation caused by movement of liquid by means of the flexible films and the gas chambers, and hence this pressure variation is not transmitted to the recording head and therefore good print quality can be ensured. Furthermore, highly accurate pressure adjustment can be achieved.

According to the present invention, since the filter and/or deaeration apparatus is provided outside the path between the first and second liquid chambers and the buffer tank(s) corresponding to same, then it is possible to reduce the load on the first and the second pumps when the pressure in the liquid chambers is controlled by using the first and second pumps to move ink between the first and second liquid chambers and the corresponding buffer tank(s). Consequently, even in the case of an ink of high viscosity and large flow volume, it is possible to control the back pressure accurately and to ensure stable ejection performance, irrespectively of the print duty.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of Inkjet Recording Apparatus

Figure 1:
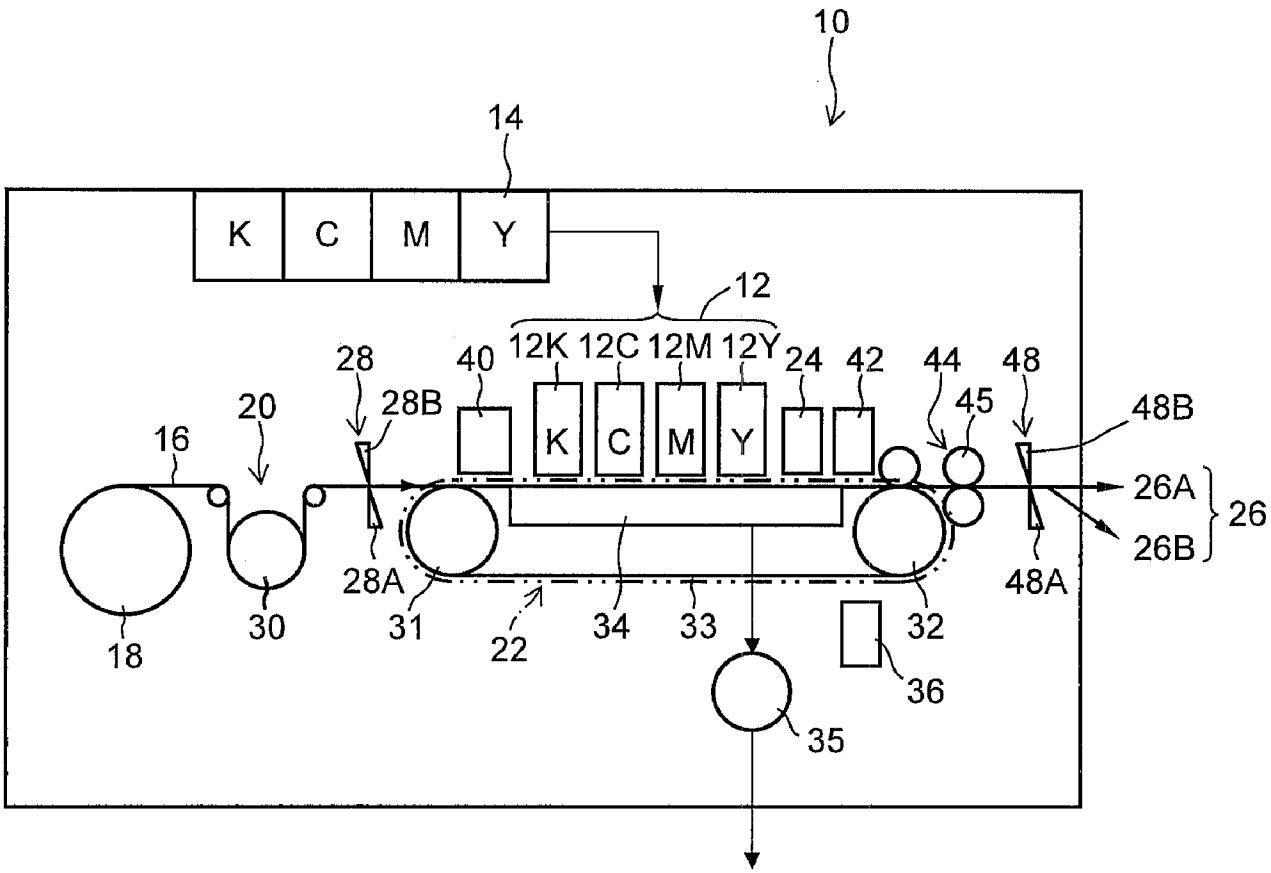
FIG. 1 is a general schematic drawing illustrating a general view of an inkjet recording apparatus.

FIG. 1 is a general configuration diagram of one embodiment of an inkjet recording apparatus according to an embodiment of the present invention. As illustrated in FIG. 1, the inkjet recording apparatus 10 comprises: a printing unit 12 having a plurality of recording heads (hereafter, also simply called "heads") 12K, 12C, 12M, and 12Y provided for the respective ink colors; an ink storing and loading unit 14 for storing inks of K, C, M and Y to be supplied to the printing heads 12K, 12C, 12M, and 12Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is preferable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
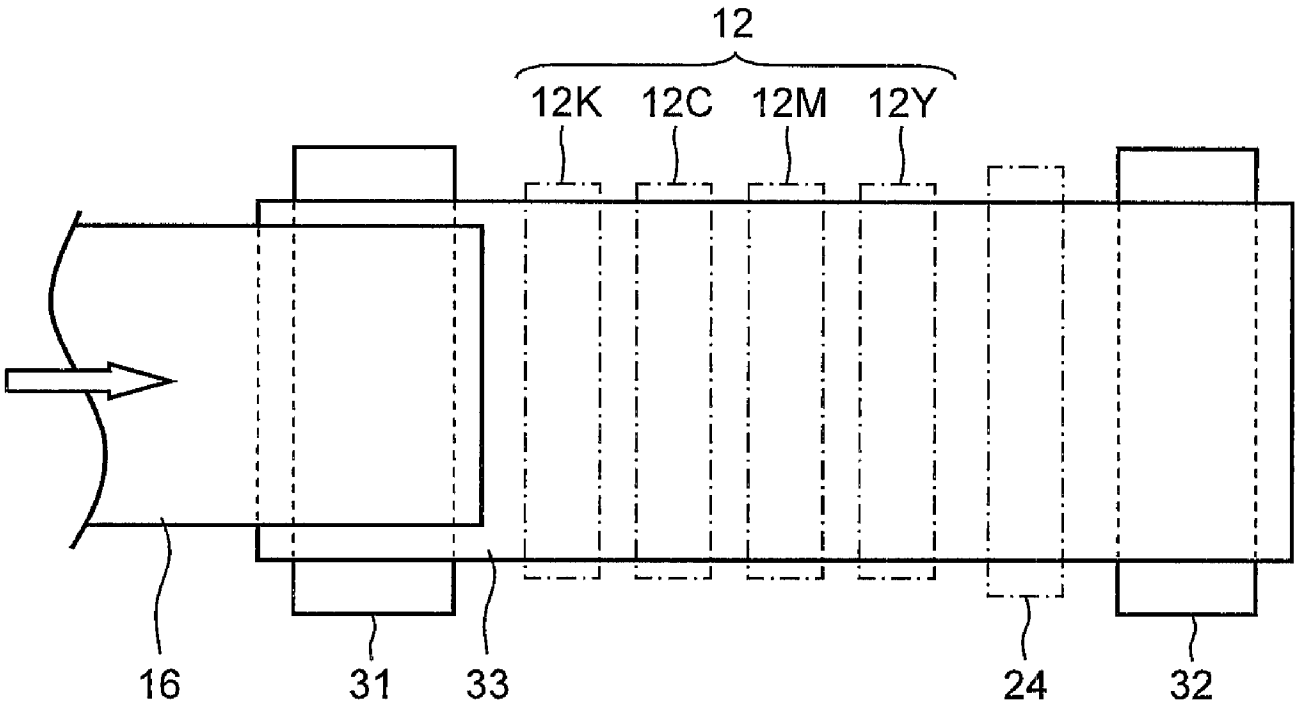
FIG. 2 is a principal plan diagram illustrating the peripheral area of a print unit of an inkjet recording apparatus.

The printing unit 12 is a so-called "full line head" in which a line head having a length corresponding to the maximum paper width is arranged in a direction (main scanning direction) that is perpendicular to the paper conveyance direction (sub scanning direction). Each of the printing heads 12K, 12C, 12M, and 12Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 12K, 12C, 12M, and 12Y are arranged in the order of black (K), cyan (C), magenta (M), and yellow (Y) from the upstream side, along the feed direction of the recording paper 16 (hereinafter, referred to as the sub-scanning direction). A color image can be formed on the recording paper 16 by ejecting the inks from the printing heads 12K, 12C, 12M, and 12Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added. Furthermore, there are no particular restrictions of the sequence in which the heads of respective colors are arranged.

As illustrated in FIG. 1, the ink storing and loading unit 14 has tanks for storing the inks of K, C, M and Y to be supplied to the heads 12K, 12C, 12M, and 12Y, and the tanks are connected to the heads 12K, 12C, 12M, and 12Y by means of channels, which are omitted from figures. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of the Head

Next, the structure of heads 12K, 12C, 12M and 12Y will be described. The heads 12K, 12C, 12M and 12Y of the respective ink colors have the same structure, and a reference numeral 50 is hereinafter designated to any of the heads.

Figure 3A:
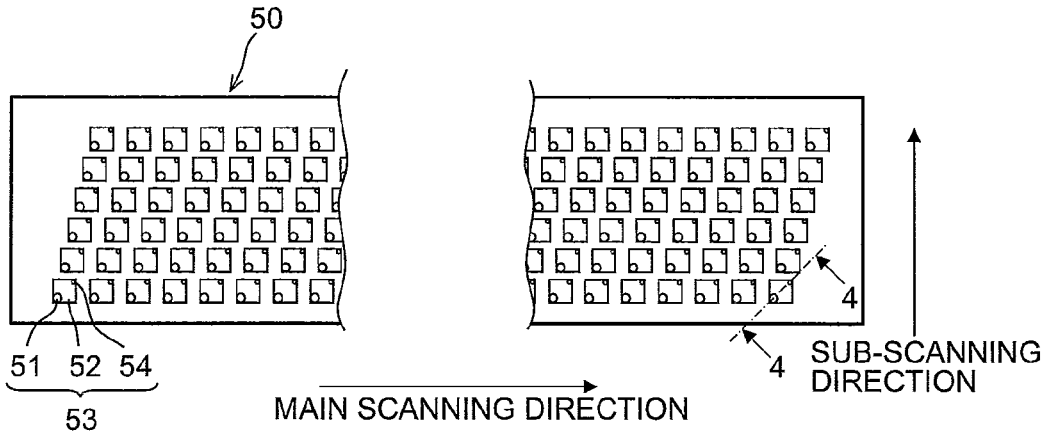
FIGS. 3A to 3C are plan view perspective diagrams illustrating examples of the composition of a print head.
Figure 3B:
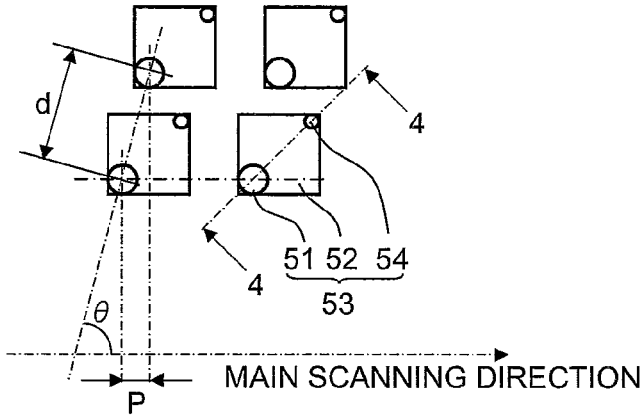
Figure 3C:
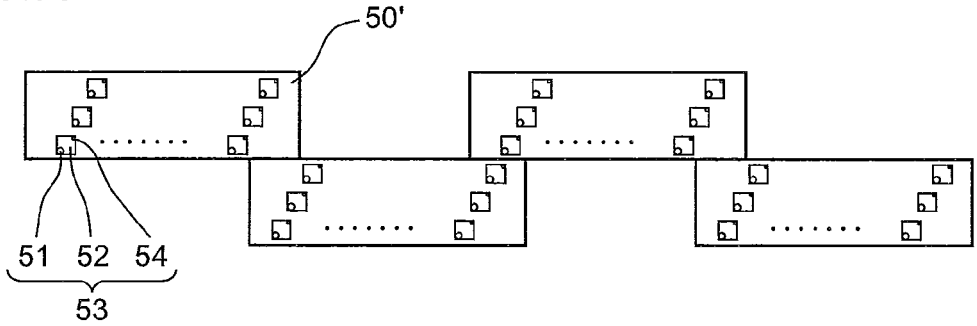
Figure 4:
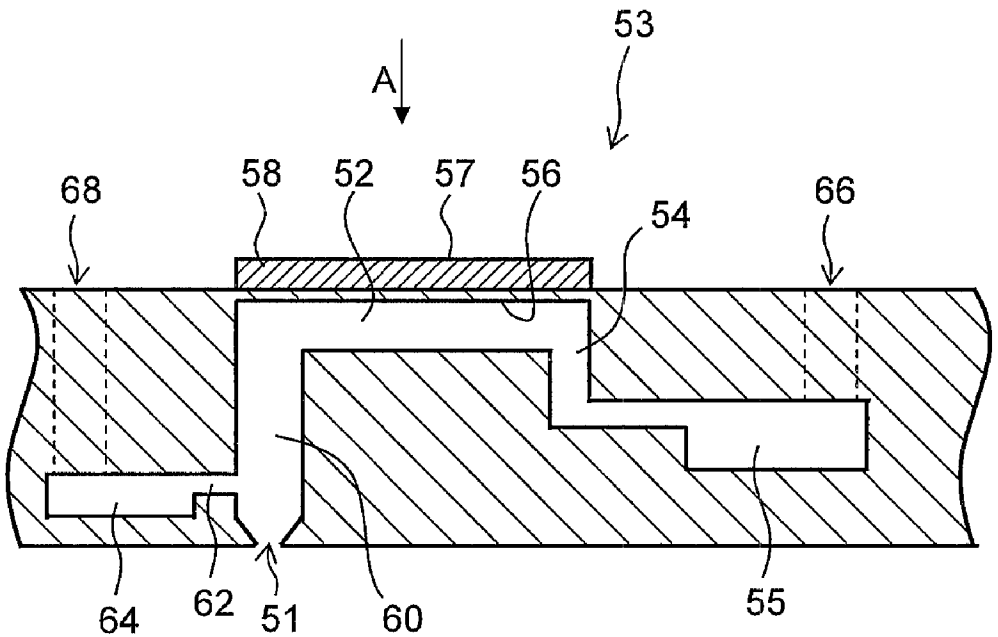
FIG. 4 is a cross-sectional diagram illustrating the composition of an ink chamber unit.
Figure 5:
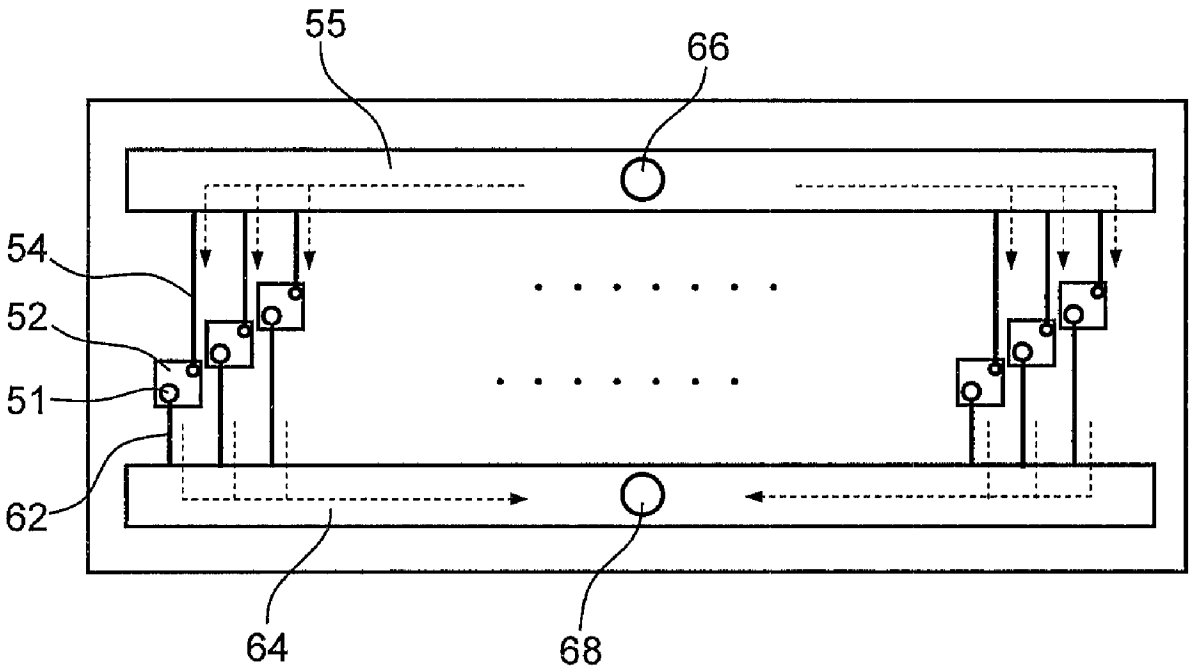
FIG. 5 is a flow channel schematic drawing illustrating the internal flow channel structure of the head.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line 4-4 in FIGS. 3A and 3B). Furthermore, FIG. 5 is a flow channel composition diagram showing the structure of flow channels inside the head 50 (a plan view perspective diagram in direction A in FIG. 4).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the recording paper 16 can be formed by arranging and combining, in a staggered matrix, short head blocks (head chips) 50' having a plurality of nozzles 51 arrayed in a two-dimensional fashion. Furthermore, although not shown in the drawings, it is also possible to compose a line head by arranging short heads in one row.

The pressure chambers 52 provided corresponding to the respective nozzles 51 are approximately square-shaped in planar form, and a nozzle 51 and an ink inlet port 54 are provided respectively at either corner of a diagonal of each pressure chamber 52. Each pressure chamber 52 is connected via the ink inlet port 54 to a common flow channel 55. Furthermore, a nozzle flow channel 60 connected to each of the pressure chambers 52 is connected via an individual flow channel 62 to a common circulation flow channel 64. A supply port 66 and an outlet port 68 are provided in the head 50, the supply port 66 is connected to the common flow channel 55, and the outlet port 68 is connected to the common circulation flow channel 64.

In other words, the supply port 66 and the outlet port 68 of the head 50 are composed so as to be connected via an ink flow channel (which corresponds to the "internal flow channel" of embodiments of the present invention) which includes the common flow channel 55, the ink inlet ports 54, the pressure chambers 52, the nozzle flow channels 60, the individual flow channels 62, and the common circulation flow channel 64. Consequently, a portion of the ink which has been supplied to the supply port 66 from outside the head is ejected from the nozzles 51, and the remainder of the ink passes successively via the common flow channel 55, the nozzle flow channels 60, the individual flow channels 62 and the common circulation flow channel 64 (in other words, it is circulated via the internal ink flow channel of the head) and then output to the exterior of the head from the outlet port 68.

As illustrated in FIG. 4, a desirable composition is one in which the individual flow channels 62 are connected to the nozzle flow channels 60 in the vicinity of the nozzles 51, and therefore since the ink is allowed to circulate in the vicinity of the nozzles 51, increase in the viscosity of the ink inside the nozzle 51 is prevented and stable ejection can be achieved.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chambers 52 from the common flow channel 55, via the ink inlet ports 54.

In the present example, a piezoelectric element 58 is used as an ink ejection force generating device which causes ink to be ejected from a nozzle 50 provided in a head 51, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 16 is scanned in the breadthways direction (main scanning direction) of the recording paper 16, thereby performing printing in the breadthways direction, and when one printing action in the breadthways direction has been completed, the recording paper 16 is moved through a prescribed amount in the direction perpendicular to the breadthways direction (the sub-scanning direction), printing in the breadthways direction of the recording paper 16 is carried out in the next printing region, and by repeating this sequence, printing is performed over the whole surface of the printing region of the recording paper 16.

Configuration of Control System

Figure 6:
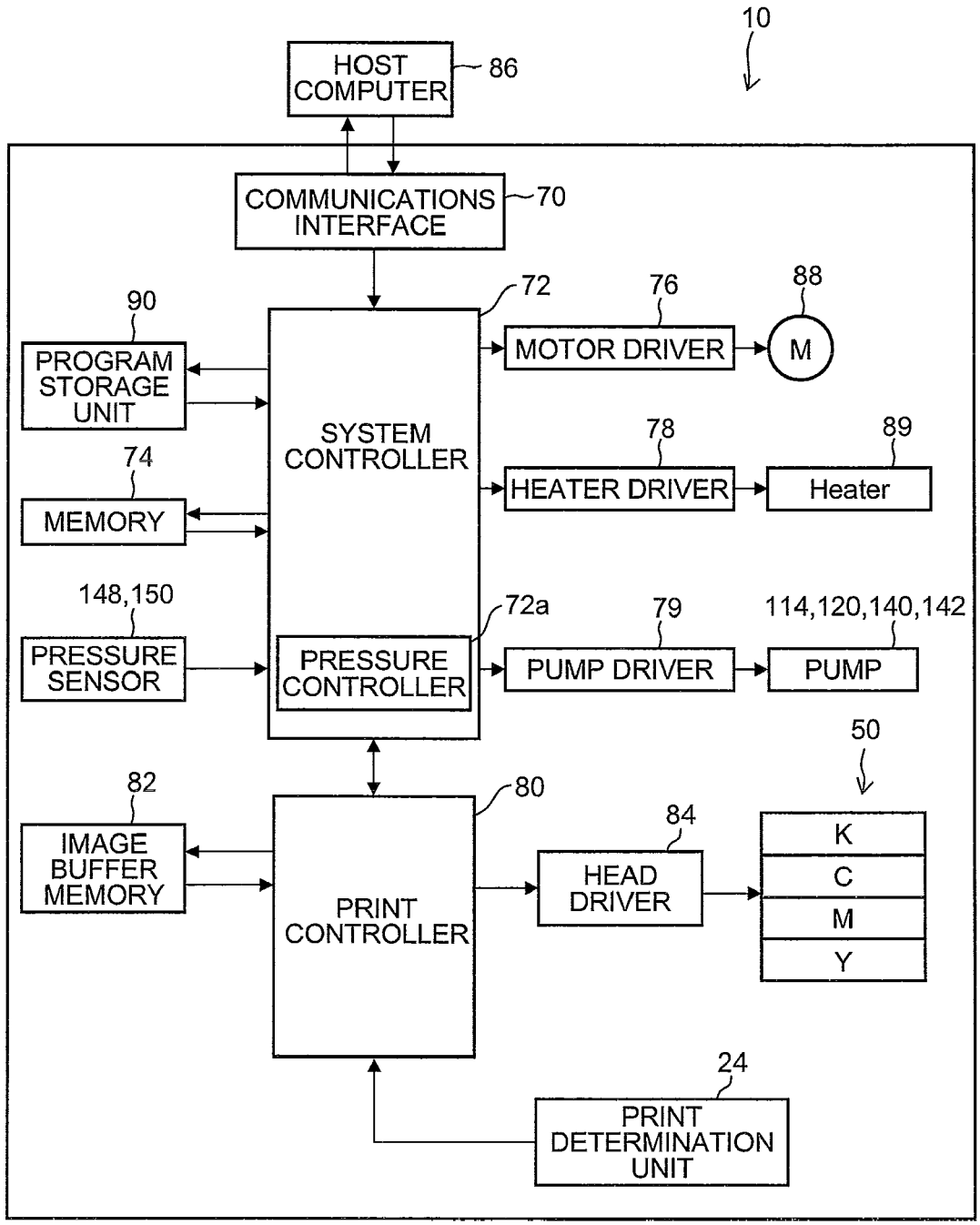
FIG. 6 is a principal block diagram illustrating the control system of an inkjet recording apparatus.

FIG. 6 is a principal block diagram showing the control system of the inkjet recording apparatus 10. The inkjet recording apparatus 10 comprises a communications interface 70, a system controller 72, a memory 74, a motor driver 76, a heater driver 78, a print controller 80, an image buffer memory 82, a head driver 84, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 10 through the communications interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective sections, such as the communications interface 70, the memory 74, the motor driver 76, the heater driver 78, and the like. The system controller 72 is made up of a central processing unit (CPU) and peripheral circuits thereof, and as well as controlling communications with the host computer 86 and controlling reading from and writing to the memory 74, and the like, and it generates control signals for controlling the motors 88 of the conveyance system and the heaters 89.

This system controller 72 comprises a pressure control unit 72*a* (corresponding to the control units 152 and 154 in FIG. 7) which controls the driving of the respective subsidiary pumps 140 and 142 of the ink supply system. As described below, the pressure control unit 72*a* controls the driving of the subsidiary pumps 140 and 142 in accordance with the determination results of the pressure sensors 148 and 150, and by moving the ink between the liquid chambers 126 and 132 of the sub tanks 106 and 108, and the buffer tanks 102 and 104 corresponding respectively to same, pressure control is implemented in such a manner that the internal pressure of the liquid chambers 126 and 132 remains constant at the target pressure (see FIG. 7).

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

The motor driver (drive circuit) 76 drives the motor 88 in accordance with commands from the system controller 72. The heater driver 78 drives the heater 89 of the post-drying unit 42 and the like in accordance with commands from the system controller 72. The heater 89 indicated in FIG. 6 includes heaters provided in the buffer tanks 102 and 104.

Furthermore, the pump driver 79 is a driver which drives the pumps 114, 120, 140, 142 of the ink supply system in accordance with instructions from the system controller 72.

The print controller 80 has a signal processing function for performing various tasks, compensations, and other types of processing for generating print control signals from the image data stored in the memory 74 in accordance with commands from the system controller 72 so as to supply the generated print control signals (dot data) to the head driver 84. Necessary signal processing is carried out in the print controller 80, and the ejection amount and the ejection timing of the ink from the respective recording heads 50 are controlled via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect illustrated in FIG. 6 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 generates drive signals for driving the piezoelectric elements 58 (see FIG. 4) of the recording heads 50 of the respective colors, on the basis of dot data supplied from the print controller 80, and supplies the generated drive signals to the piezoelectric elements 58. A feedback control system for maintaining constant drive conditions in the recording heads 50 may be included in the head driver 84.

The print determination unit 24 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print controller 80.

According to requirements, the print controller 80 makes various corrections with respect to the recording head 50 on the basis of information obtained from the print determination unit 24.

Various control programs are stored in the program storage unit 90, and the control programs are read out and executed in accordance with commands from the system controller 72. The program storage unit 90 may use a semiconductor memory, such as a ROM, EEPROM, or a magnetic disk, or the like. An external interface may be provided, and a memory card or PC card may also be used. Naturally, a plurality of these recording media may also be provided. The program storage unit 90 may also be combined with a storage device for storing operational parameters, and the like (not illustrated).

Composition of Ink Supply System

Next, an example of the composition of the ink supply system of the inkjet recording apparatus 10 which is a characteristic portion of embodiments (first and second embodiments) will be described.

First Embodiment

Figure 7:
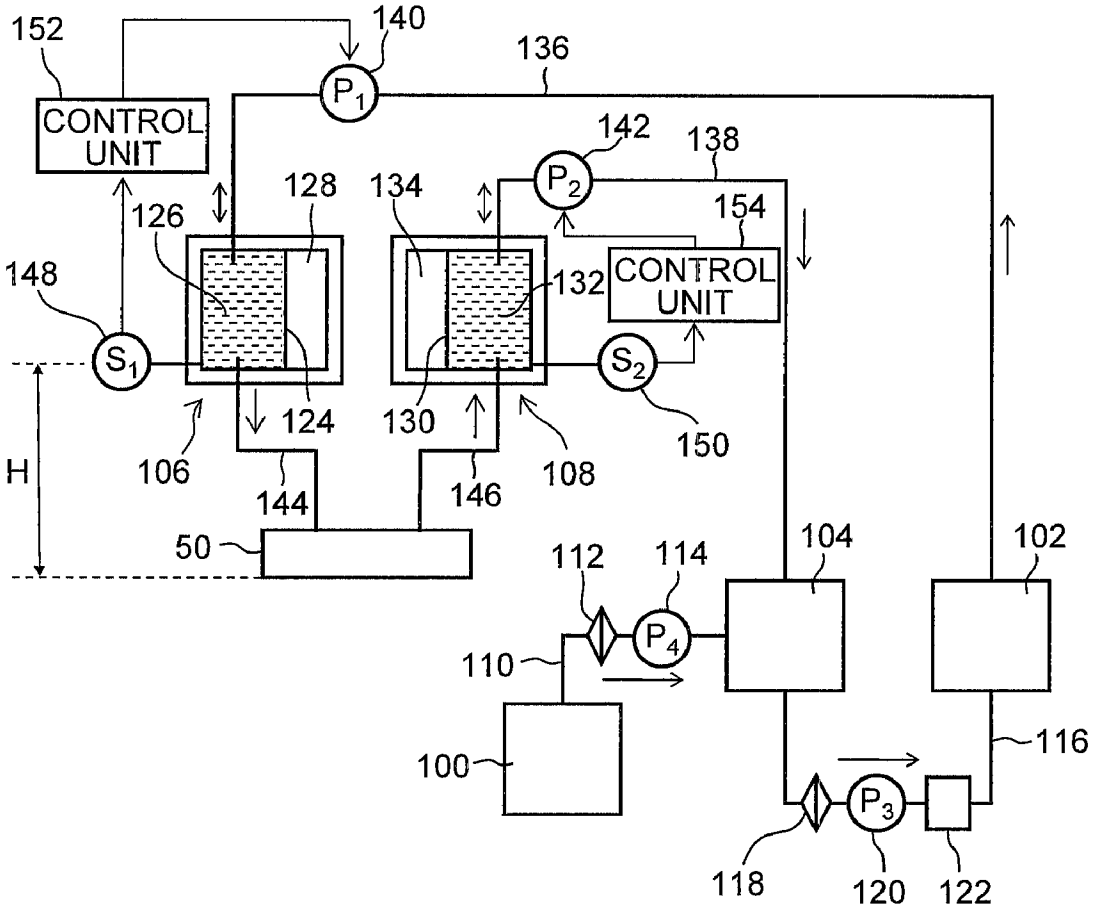
FIG. 7 is an approximate diagram illustrating an example of the composition of an ink supply system according to a first embodiment.

FIG. 7 is an approximate diagram showing an example of the composition of an ink supply system according to a first embodiment. In FIG. 7, in order to simplify the description, the ink supply system relating to only one color is depicted, but in the case of a plurality of colors, a plurality of similar compositions are provided.

As illustrated in FIG. 7, the ink supply system relating to the first embodiment principally comprises: a main tank 100, a first buffer tank 102, a second buffer tank 104, a supply sub tank 106 and a recovery sub tank 108.

The main tank 100 is a base tank (ink supply source) which stores ink for supplying to the head 50, and corresponds to the tank which is disposed in the ink storage and loading unit 14 illustrated in FIG. 1. The main tank 100 is connected to a second buffer tank 104 via the flow channel 110. The main tank 100 may be connected to the first buffer tank 102 instead of the second buffer tank 104. A filter 112 and a main pump 114 are provided in the flow channel 110 in this order from the main tank 100 side, and ink is supplied from the main tank 100 to the second buffer tank 104 via the filter 112 in accordance with the driving of the main pump 114.

The first and second buffer tanks 102 and 104 are constituted respectively by containers having air connection ports which connect the interior with the exterior (in other words, the interiors of the tanks are open to the air), and function as liquid storage units which temporarily store ink to be supplied to the head 50 and ink that has been circulated through the head 50. Furthermore, heaters are provided respectively in each of the buffer tanks 102 and 104, and have the function of adjusting the temperature of the ink stored therein.

The first buffer tank 102 and the second buffer tank 104 are connected via a flow channel 116. A filter 118, a circulating pump 120, and a deaeration apparatus 122 are provided in this order from the side of the second buffer tank 104, in the flow channel 116, and ink is supplied (circulated) from the second buffer tank 104 to the first buffer tank 102 via the filter 118 and the deaeration apparatus 122 in accordance with driving of the circulation pump 120. In this case, the ink in the second buffer tank 104 is supplied to the first buffer tank 102 in a state where foreign material such as ink component having increased viscosity has been removed by the filter 118 and dissolved gas has been removed by the deaeration apparatus 122.

In the present embodiment, there are no particular restrictions on the sequence in which the filter 118 and the deaeration apparatus 122 are disposed, but from the viewpoint of preventing blockages of the deaeration apparatus 122 and extending the life of the deaeration apparatus 122, a desirable mode is one where the ink is introduced into the deaeration apparatus 122 after having passed through the filter 118, as illustrated in FIG. 7. The deaeration apparatus 122 may employ commonly known technology, and therefore description thereof is omitted here.

A supply sub tank 106 and a recovery sub tank 108 are disposed vertically above the head 50 (and desirably in close proximity to the head). The sub tanks 106 and 108 have the same composition in which the interior of a hermetically sealed container is divided into two spaces by means of a flexible film. More specifically, a liquid chamber 126 and a gas chamber 128 are formed on either side of a flexible film 124 inside the supply sub tank (sealed container) 106, and similarly, a liquid chamber 132 and a gas chamber 134 are formed on either side of a flexible film 130 inside the recovery sub tank (sealed container) 108. Of course, in implementing embodiments (including this embodiments) of the present invention, it is not strictly necessary for the sub tanks 106 and 108 to have the same composition.

A desirable mode is one where the movable films 124 and 130 are constituted by an elastic film (made of rubber, for example). It is possible to attenuate sudden pressure variation caused by the subsidiary pumps 140 and 142 and the ejection of ink by the head 50, by means of the elastic force of the elastic film and suitable elastic force created by the compressive properties of the gas chamber. In the present embodiment, air is filled into the gas chambers 128 and 134, but this embodiment of the invention is not limited to this and a gas other than air may also be filled into the gas chambers.

The liquid chambers 126 and 132 of the sub tanks 106 and 108 are connected to respectively corresponding buffer tanks 102 and 104. More specifically, the liquid chamber 126 of the supply sub tank 106 is connected to the first buffer tank 102 via a flow channel 136, and similarly, the liquid chamber 132 of the recovery sub tank 108 is connected to the second buffer tank 104 via a flow channel 138. A first and a second sub pump 140 and 142 which can be driven in both the forward and reverse directions are provided respectively in the flow channels 136 and 138, and ink can be moved in both directions between the liquid chambers 126 and 132 of the sub tanks 106 and 108 and their corresponding buffer tanks 102 and 104. For example, if the first subsidiary pump 140 is driven in the forward direction, then it is possible to move the ink from the first buffer tank 102 to the liquid chamber 126 of the supply sub tank 106, whereas when it is driven in the reverse direction, it is possible to move ink from the liquid chamber 126 of the supply sub tank 106 to the first buffer tank 102. The same applies to the second sub pump 142.

The liquid chambers 126 and 132 of the sub tanks 106 and 108 are connected to the head 50 respectively via flow channels 144 and 146. More specifically, the liquid chamber 126 of the supply sub tank 106 is connected to the head 50 via a flow channel 144, and similarly, the liquid chamber 132 of the recovery sub tank 108 is connected to the head 50 via a flow channel 146. To explain in more detail, the other end of the flow channel 144 which is connected to the liquid chamber 126 of the supply sub tank 106 is connected to a supply port 66 of the head 50, and the other end of the flow channel 146 which is connected to the liquid chamber 132 of the recovery sub tank 108 is connected to an output port 68 of the head 50 (see FIGS. 4 and 5). Consequently, as described hereinafter, by providing a prescribed pressure differential to the liquid chambers 126 and 132 of the sub tanks 106 and 108, it is possible to circulate the ink from the liquid chamber 126 of the supply sub tank 106 via the ink flow channels inside the head 50 (the common flow channel 55, the pressure chambers 52, the common circulation flow channel 64, and the like), to the liquid chamber 132 of the recovery sub tank 108.

Furthermore, a first and a second pressure sensor 148 and 150 which respectively determine the internal pressures of the liquid chambers 126 and 132 of the sub tanks 106 and 108 are provided, and in addition, control units 152 and 154 which respectively control the internal pressures of the respective liquid chambers 126 and 132 are also provided. The control units 152 and 154 are equivalent to the pressure control unit 72*a* illustrated in FIG. 6.

The control units 152 and 154 set target pressures for the liquid chambers 126 and 132 of the sub tanks 106 and 108 in such a manner that a prescribed back pressure (negative pressure) is applied to the ink inside the head 50 while a prescribed pressure differential is provided between the liquid chambers 126 and 132 of the sub tanks 106 and 108, and the control units 152 and 154 control the internal pressures of the liquid chambers 126 and 132 respectively in accordance with the determination results of the corresponding pressure sensors 148 and 150 in such a manner that the internal pressures of the liquid chambers 126 and 132 of the sub tanks 106 and 108 are kept constant at the target pressures.

To give a more detailed description, the control units 152 and 154 set the target pressures of the liquid chambers 126 and 132 in such a manner that an ink meniscus is maintained in each of the nozzles 51 of the head 50 and the internal pressure of the liquid chamber 126 of the supply sub tank 106 is relatively higher than the internal pressure of the liquid chamber 132 of the recovery sub tank 108, and the corresponding subsidiary pumps 140 and 142 are driven respectively on the basis of the determination results of the pressure sensors 148 and 150 so as to control the pressures in such a manner that the internal pressures of the liquid chambers 126 and 132 are kept constant at the target pressures by moving the ink between the liquid chambers 126 and 132 of the sub tanks 106 and 108, and the respectively corresponding buffer tanks 102 and 104.

In this case, the pressure differential between the liquid chambers 126 and 132 of the sub tanks 106 and 108 is provided so as to satisfy the following conditions. In other words, in the example illustrated in FIG. 7, taking the target pressure of the liquid chamber 126 of the supply sub tank 106 as $P_{in}$, taking the target pressure of the liquid chamber 132 of the recovery sub tank 108 as $P_{out}$, taking the back pressure of the ink inside the nozzles 51 of the head 50 as $P_{nzl}$, and taking the pressure differential based on the height difference H between the liquid chambers 126 and 132 and the nozzle surface (ink ejection surface) of the head 50 as $\Delta P_h$, then a pressure differential is provided between the liquid chambers 126 and 132 so as to satisfy the following relationship:

$$P_{in}+\Delta P_h>P_{nzl}>P_{out}+\Delta P_h \quad \text{Expression (1)}$$

Furthermore, Expression (1) may also be written in the following form, if the unit of pressure is set to $mmH_2O$.

$$P_{in}+H>P_{nzl}>P_{out}+H \quad \text{Expression (2)}$$

Furthermore, in the example illustrated in FIG. 7, the liquid chambers 126 and 132 are disposed at the same height, but if they are disposed at different heights, then Expression (1) should be modified in accordance with this height differential. In other words, taking the pressure differential caused by the height difference between the liquid chamber 126 of the supply sub tank 106 and the nozzle surface of the head 50 to be $\Delta P_{h1}$, and taking the pressure differential caused by the height difference between the liquid chamber 132 of the recovery sub tank 108 and the nozzle surface of the head 50 to be $\Delta P_{h2}$, then a pressure differential is provided between the liquid chambers 126 and 132 so as to satisfy the following relationship:

$$P_{in}+\Delta P_{h1}>P_{nzl}>P_{out}+\Delta P_{h2} \quad \text{Expression (3)}$$

In this way, according to the present embodiment, since control is implemented in such a manner that the internal pressures of the liquid chambers 126 and 132 of the sub tanks 106 and 108 remain constant at the target pressures, then it is possible to circulate the ink continuously at a prescribed speed from the liquid chamber 126 of the supply sub tank 106 via the ink flow channels inside the head 50 (the common flow channel 55, the pressure chambers 52 and the common circulation flow channel 64, and the like) to the liquid chamber 132 of the recovery sub tank 108, while maintaining the ink meniscus in the nozzles 51 of the head 50. In particular, since the buffer tanks 102 and 104 are constituted by containers of which the interiors are respectively open to the air, then it is possible to control the internal pressures of the liquid chambers 126 and 132 in a mutually independent fashion, without the ink that flows out from the liquid chambers 126 and 132 of the sub tanks 106 and 108 encountering a dead-end situation.

Furthermore, when the ink is moved between the liquid chambers 126 and 132 of the sub tanks 106 and 108 and the buffer tanks 102 and 104 corresponding respectively to same in accordance with the driving of the subsidiary pumps 140 and 142, the flexible films (which are desirably elastic films) 124 and 130 and the gas chambers 128 and 134 of the sub tanks 106 and 108 function as dampers which attenuate the pressure variation caused by the subsidiary pumps 140 and 142, and therefore it is possible to prevent pressure variations from being transmitted to the head 50, and consequently good print quality can be maintained. Moreover, it is also possible to control ink circulation at a very slow flow speed.

Consequently, it is possible to achieve back pressure control of high-precision, irrespective of the ink consumption (in other words, the print duty) in the head 50. Furthermore, since the ink is circulated constantly inside the head 50 (especially in the vicinity of the nozzles), irrespectively of the ejection state of the head 50, then it is possible to prevent ejection defects caused by increased viscosity of the ink, or the like, and therefore satisfactory print quality can be maintained over a long period of time.

Moreover, according to the present embodiment, the filter 118 and the deaeration apparatus 122 which generate large pressure losses are disposed to the outside of the flow channels (the flow channels 136 and 138) between the liquid chambers 126 and 132 of the sub tanks 106 and 108 and the buffers tanks 102 and 104 corresponding to these, and therefore when the pressure of the liquid chambers 126 and 132 is controlled by using the subsidiary pumps 140 and 142 to move the ink between the liquid chambers 126 and 132 and the buffer tanks 102 and 104 corresponding to these, then it is possible greatly to reduce the load on the subsidiary pumps 140 and 142 compared to a case where the filter or deaeration apparatus is disposed in the flow channels described above (the flow channels 136 and 138). Therefore, even if using an ink having high viscosity (1 to 10 cP) and a high flow rate (1 to 10 ml/sec), it is possible to control the back pressure with high precision as well as being able to ensure stable ejection performance, irrespectively of the print duty. By this means, it is possible to improve the ejection reliability of the head 50 and to obtain stable and satisfactory print quality.

On the other hand, in the present embodiment, the filter 118 and the deaeration apparatus 122 are provided in a flow channel 116 which connects the first and second buffer tanks 102 and 104, and therefore when the ink moved from the liquid chamber 132 of the recovery sub tank 108 to the second buffer tank 104 is supplied to the first buffer tank 102 together with ink that has been supplied from the main tank 100, in accordance with the driving of the circulation pump 120, foreign material, such as increased viscosity components in the ink, is removed by the filter 118 and furthermore dissolved gas is removed by the deaeration apparatus 122. Consequently, ink which is free of foreign material and has a good deaeration rate is supplied (circulated) to the liquid chamber 126 of the supply sub tank 106 from the first buffer tank 102. As a result of this, the ink supplied to the head 50 is in a good state at all times and therefore stable ejection performance can be ensured.

Furthermore, since the buffer tanks 106 and 108 are provided with a temperature adjustment function, then it is also possible to control the temperature of the ink after deaeration, as well as the ink before deaeration, and the rate at which the oxygen dissolves into the solvent can be slowed, thus leading to an increase in the deaeration effect. Moreover, it also becomes possible to achieve precise temperature control.

Moreover, since each of the internal pressures of the liquid chambers 126 and 132 of the sub tanks 106 and 108 can be controlled, then there is a high degree of freedom for arrangement of the sub tanks 106 and 108 with respect to the head 50 and it is possible to make the apparatus compact in size. In other words, in implementing this embodiment of the present invention, there are no particular restrictions on the positions where the sub tanks 106 and 108 with respect to the head 50 are disposed, and for example, it is also possible to dispose the sub tanks 106 and 108 vertically below the head 50. However, as illustrated in the present embodiment, a desirable mode is one in which the sub tanks 106 and 108 are disposed in the vicinity of the head 50 vertically above same. It is possible to shorten the flow channels 144 and 146 which connect the head 50 with the sub tanks 106 and 108, and it is also possible to reduce pressure variations caused by pressure loss in the flow channels 144 and 146. Therefore, it is possible to improve the accuracy of the pressure differential applied between the supply port 66 and the outlet port 68 of the head 50 and therefore a circulation of ink at low speed can be achieved in the vicinity of the nozzles.

Moreover, in the present embodiment, a liquid chamber and a gas chamber are formed on either side of a flexible film, inside each of the sub tanks 106 and 108, but the invention is not limited to this and it is also possible to form only a liquid chamber inside the sub tanks.

In the case of a mode where only a liquid chamber is formed inside the sub tank, desirably, a flexible film (desirably, an elastic film) is provided in a portion of the wall of the sub tank (i.e. in between the liquid chamber inside the sub tank and the exterior of the sub tank). However, in cases of this kind, since no elastic force based on the compressive properties of the gas chamber is obtained, then although the effect in attenuating sudden pressure variations in the liquid chamber is increased, it is necessary to take account of the decline in the responsiveness of the pressure control by means of the subsidiary pumps. Accordingly, it is desirable to set the elastic force of the flexible film to an appropriate force by altering the elastic force of the flexible film or by providing a spring member which impels the flexible film, or another such method.

Second Embodiment

Next, a second embodiment of the present invention will be described. Below, portions which are common with the first embodiment are not explained further, and the following description centers on the characteristic features of the present embodiment.

Figure 8:
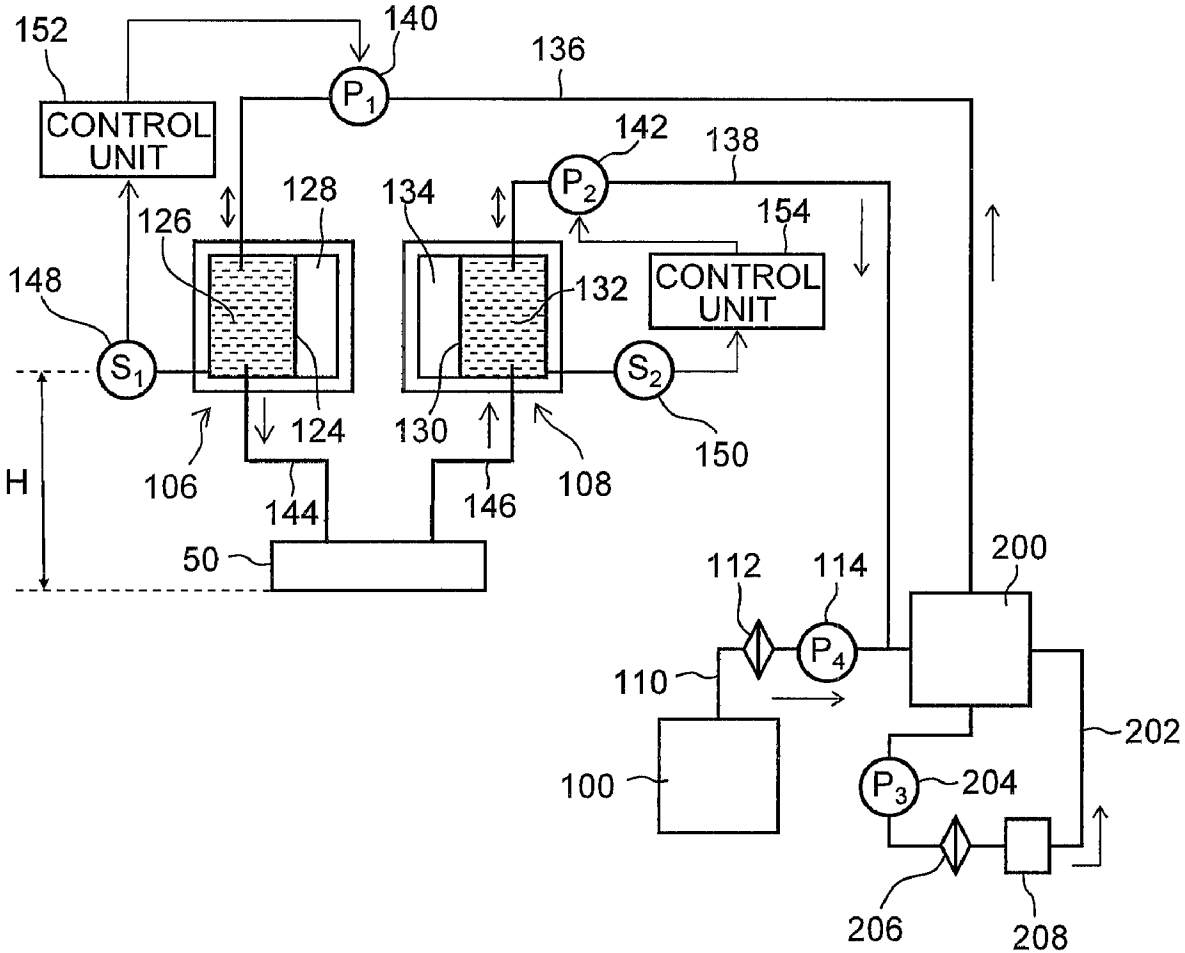
FIG. 8 is an approximate diagram illustrating an example of the composition of an ink supply system according to a second embodiment.

FIG. 8 is an approximate diagram illustrating an example of the composition of an ink supply system according to a second embodiment. In FIG. 8, parts which are common with FIG. 7 are labeled with the same reference numerals.

As illustrated in FIG. 8, the ink supply system relating to the second embodiment principally comprises: a main tank 100, a buffer tank 200, a supply sub tank 106 and a recovery sub tank 108. In other words, whereas, in the first embodiment, two buffer tanks are provided, the second embodiment differs from this in that one buffer tank is provided.

The main tank 100 and the buffer tank 200 are connected via the flow channel 110. A filter 112 and a main pump 114 are provided in the flow channel 110 in this order from the main tank 100 side, and ink is supplied from the main tank 100 to the buffer tank 200 via the filter 112 in accordance with the driving of the main pump 114.

Similarly to the buffer tanks 102 and 104 according to the first embodiment, the buffer tank 200 is constituted by a container having an air connection port which connects the interior with the exterior (in other words, the interiors of the tanks are open to the air), and functions as a liquid storage unit which temporarily stores ink to be supplied to the head 50 and ink that has been circulated through the head 50. Furthermore, a heater is provided in the buffer tank and has the function of adjusting the temperature of the ink stored therein.

Moreover, the buffer tank 200 comprises a circulation flow channel 202 by which the ink inside the tank is circulated. A circulation pump 204, a filter 206 and a deaeration apparatus 208 are provided in this order from the upstream side in the circulation flow channel 202, and in accordance with the driving of the circulation pump 204, the ink inside the buffer tank 200 is passed through the filter 206, thereby removing foreign material such as increased viscosity components, is passed through the deaeration apparatus 208, thereby removing dissolved gas, and is then returned again to the buffer tank 200.

The liquid chambers 126 and 132 of the sub tanks 106 and 108 are connected to the buffer tank 200 respectively via the flow channels 136 and 138, and by means of the control units 152 and 154 driving the respectively corresponding subsidiary pumps 140 and 142 on the basis of the determination results from the pressure sensors 148 and 150 and thereby moving ink between the liquid chambers 126 and 132 of the sub tanks 106 and 108 and the buffer tank 200, pressure control is implemented in such a manner that the internal pressures of the liquid chambers 126 and 132 are kept uniformly at their target pressures.

The flow channel 138 on the recovery tank 108 side is connected to a prescribed position of the flow channel 110 between the main tank 100 and the buffer tank 200 (more specifically, to a position between the pump 114 and the buffer tank 200), and a composition is adopted in which the ink inside the liquid chamber 132 of the recovery sub tank 108 is circulated via the buffer tank 200 rather than being circulated directly to the liquid chamber 126 of the supply sub tank 106. Furthermore, the flow channel 138 on the recovery tank 108 side does not have to be connected directly to the buffer tank 200.

In the present embodiment, similarly to the first embodiment, the filter 206 and the deaeration apparatus 208 which generate large pressure losses are separated from the path (flow channels 136 and 138) between the liquid chambers 126 and 132 of the sub tanks 106 and 108, and the buffer tank 200, and therefore it is possible to reduce the load on the first and second subsidiary pumps 140, 142 which are used to control the pressure in the liquid chambers 126 and 132 of the subsidiary tanks 106 and 108. Therefore, even if using an ink having high viscosity (1 to 10 cP) and a high flow rate (1 to 10 ml/sec), it is possible to control the back pressure with high precision as well as being able to ensure stable ejection performance, irrespectively of the print duty. By this means, it is possible to improve the ejection reliability of the head 50 and to obtain stable and satisfactory print quality.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

a recording head of an inkjet type including an introduction section of introducing liquid into the recording head, a discharge section of discharging the liquid that has circulated through an interior of the recording head, to an exterior of the recording head, and a plurality of nozzles from which droplets of the liquid are ejected;

a first liquid chamber connected to the introduction section of the recording head;

a second liquid chamber connected to the discharge section of the recording head;

a buffer tank which is connected to the first liquid chamber and the second liquid chamber, and an interior of which is open to air;

a liquid supply source which is connected to the buffer tank;

a first pump which moves the liquid in both directions between the first liquid chamber and the buffer tank;

a second pump which moves the liquid in both directions between the second liquid chamber and the buffer tank;

a pressure determination device which determines internal pressures of the first liquid chamber and the second liquid chamber; and a pressure control device which sets respective target pressures of the first liquid chamber and the second liquid chamber in such a manner that a prescribed back pressure is applied to the liquid inside the plurality of nozzles of the recording head while a prescribed pressure differential is provided between the first liquid chamber and the second liquid chamber, and controls driving of the first pump and the second pump in accordance with determination results of the pressure determination device so as to control pressures in the first liquid chamber and the second liquid chamber in such a manner that the internal pressures of the first liquid chamber and the second liquid chamber remain constant at the target pressures respectively, wherein the buffer tank has a circulation flow channel, at least one of a filter and a deaeration device is provided in the circulation flow channel, and the liquid in the buffer tank is circulated to the buffer tank via the at least one of the filter and the deaeration device provided in the circulation flow channel, a flow outlet of the at least one of the filter and the deaeration device being directly connected to a flow inlet of the buffer tank.

2. The inkjet recording apparatus as defined in claim 1, wherein the buffer tank has a temperature adjustment function.

3. The inkjet recording apparatus as defined in claim 1 comprising a first sub tank and a second sub tank, wherein the first sub tank has a first closed container containing a first gas chamber and the first liquid chamber which are separated by a first flexible film, and the second sub tank has a second closed container containing a second gas chamber and the second liquid chamber which are separated by a second flexible film.

* * * * *